US012797764B2

(12) United States Patent
Scarborough

(10) Patent No.: US 12,797,764 B2
(45) Date of Patent: Nov. 17, 2026

(54) PICKING FIDGET DEVICE

(71) Applicant: Hannah Scarborough, Syracuse, DE (US)

(72) Inventor: Hannah Scarborough, Syracuse, DE (US)

( * ) Notice: Subject to any disclaimer, the term of this patent is extended or adjusted under 35 U.S.C. 154(b) by 162 days.

(21) Appl. No.: 18/954,714

(22) Filed: Nov. 21, 2024

(65) Prior Publication Data

US 2026/0138040 A1 May 21, 2026

(51) Int. Cl.
*A63H 33/00* (2006.01)

(52) U.S. Cl.
CPC ..... *A63H 33/00* (2013.01)

(58) Field of Classification Search
CPC ..... A63H 33/00; A63H 33/32; G09B 19/00; G09B 19/24; A63F 7/36; A63F 7/3603; A63F 7/3674
See application file for complete search history.

(56) References Cited

U.S. PATENT DOCUMENTS 2,985,451 A * 5/1961 Sims ..... A63F 9/00 273/447
3,717,341 A * 2/1973 Blanton, Jr. ..... A63F 9/06 273/447
3,811,681 A * 5/1974 Sprouse ..... A63H 33/26 273/139
3,960,377 A * 6/1976 Doyle ..... A63F 9/00 273/459
4,050,697 A * 9/1977 Purviance ..... A63F 7/3603 209/479
5,248,153 A * 9/1993 Jones ..... A63F 9/00 273/459
5,458,342 A * 10/1995 Hernandez ..... A63F 9/30 273/447
5,494,472 A 2/1996 Levy
9,011,157 B2 * 4/2015 Gunasekaran ..... A63F 9/0666 434/258
11,878,253 B1 1/2024 Benn
2005/0163973 A1 7/2005 Drinkward
2008/0305461 A1 12/2008 Nichols
2011/0177479 A1 * 7/2011 King ..... A63F 3/00145 446/268
2019/0197922 A1 6/2019 Pierce
2021/0151166 A1 5/2021 Schmid

* cited by examiner

*Primary Examiner* — Kurt Fernstrom

(57) ABSTRACT

A picking fidget device for soothing a picking urge of a user includes a pad which is comprised of a thermoplastic material such that the pad transitions between a first state and a second state depending upon a temperature of the pad. A plurality of beads is insertable into the pad when the pad is in the first state. Each bead of the plurality of beads is removable from the pad when the pad is in the second state to soothe the user's compulsive urge to pick at themselves. A tool is urgeable into a gripping condition to enable the user to remove each bead of the plurality of beads from the pad when the pad is in the second state. The tool is biased into a releasing condition to release each bead of the plurality of beads when the user releases the tool.

10 Claims, 5 Drawing Sheets

PICKING FIDGET DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fidget devices and more particularly pertains to a new fidget device for soothing a picking urge of a user. The fidget device includes a pad which is comprised of a thermoplastic material such that the pad transitions between a solid phase and liquid phase depending upon the temperature of the pad. The device includes a plurality of beads that is each partially submergible in the pad when the pad is in the liquid phase. The device includes a tool which can be employed by the user to remove each bead from the pad when the pad is in the solid phase to soothe the picking urge of the user.

(2) Description of Related Art Including Information Disclosed Under 37 CFR 1.97 and 1.98

The prior art relates to fidget devices including: a toy figure device that includes rupturable microcapsules which contain a colored medium which can be ruptured by a user; a hand occupying device which includes a porous rock and a latex glue that is applied to the porous rock and which is subsequently removed from the porous rock by a user; a novelty article which includes a housing that is structured to define a cavity withing the structure and a fluid compound contained in the cavity which flows from the cavity when mechanical pressure is applied to the housing; a multi-sensory teaching kit that includes a plurality of edible items of symbolic shapes and handbook including a glossary of meanings for the symbolic shapes; a pimple popping simulator which includes a pliable body that has a plurality of pore mimicking channels and a filing in the pliable body that flows from the pore mimicking channels when the pliable body is squeezed; a stress reduction system including a plurality of objects designed to relieve anxiety through the five physical senses of human beings. In no instance does the prior art disclose a picking fidget device that includes a pad that is comprised of a thermoplastic material that transitions between a solid phase and a liquid phase and a plurality of beads that are partially submergible in the pad when the pad is in the liquid phase to enable a user to remove the plurality of beads from the pad to soothe the user's compulsive need to pick at themselves.

BRIEF SUMMARY OF THE INVENTION

An embodiment of the disclosure meets the needs presented above by generally comprising a pad which is comprised of a thermoplastic material such that the pad transitions between a first state and a second state depending upon a temperature of the pad. A plurality of beads is insertable into the pad when the pad is in the first state. Each bead of the plurality of beads is removable from the pad when the pad is in the second state to soothe a picking urge of the user. A tool is urgeable into a gripping condition to enable the user to remove each bead of the plurality of beads from the pad when the pad is in the second state. The tool is biased into a releasing condition to release each bead of the plurality of beads when the user releases the tool.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
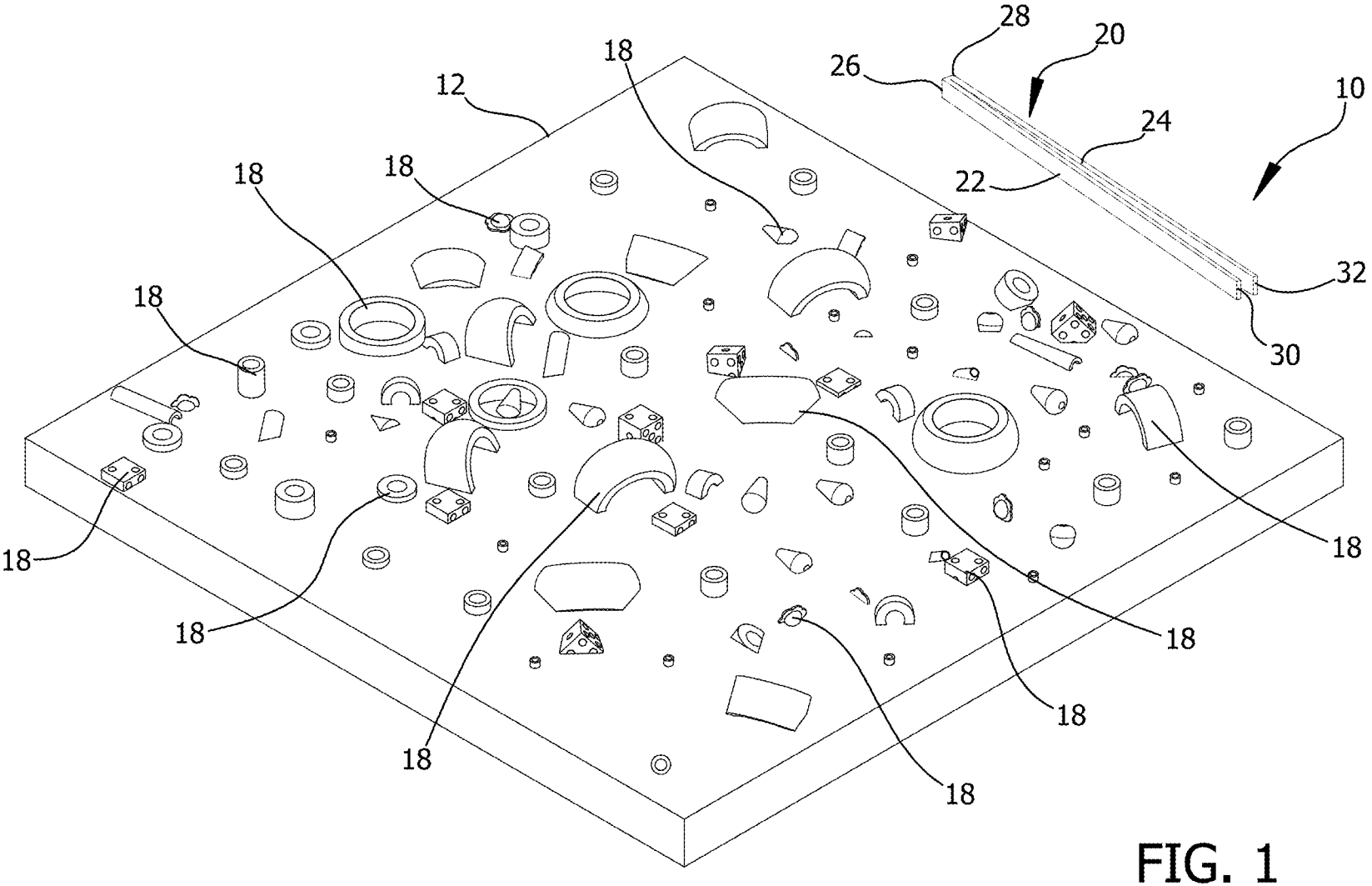
FIG. 1 is a top perspective view of a picking fidget device according to an embodiment of the disclosure.

With reference now to the drawings, and in particular to FIGS. 1 through 5 thereof, a new fidget device embodying the principles and concepts of an embodiment of the disclosure and generally designated by the reference numeral 10 will be described.

As best illustrated in FIGS. 1 through 5, the picking fidget device 10 generally comprises a pad 12 which is comprised of a thermoplastic material, including but not being limited to meltable silicone, such that the pad 12 transitions between a first state and a second state depending upon a temperature of the pad 12. Furthermore, the pad 12 can be warmed or cooled by a user 14 to transition the pad 12 between the first state and the second state. The pad 12 is thermally activated into a liquid phase when the pad 12 is heated above a melting temperature of the pad 12 thereby enabling the pad 12 to be poured into a mold 16. Conversely, the pad 12 is thermally activated into a solid phase when the pad 12 is cooled below the melting temperature of the pad 12 thereby enabling the pad 12 to solidify in the mold 16.

Figure 3:
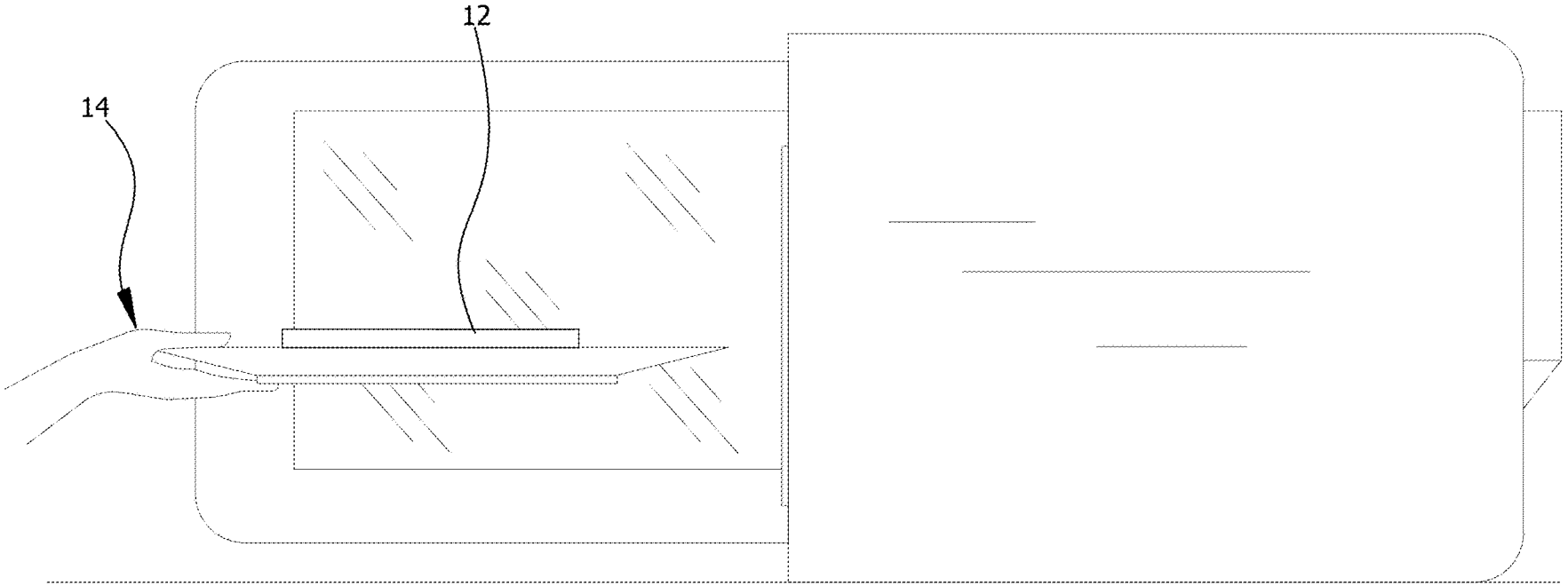
FIG. 3 is a perspective in-use view of an embodiment of the disclosure showing a pad being positioned in a microwave oven for warming the pad.
Figure 4:
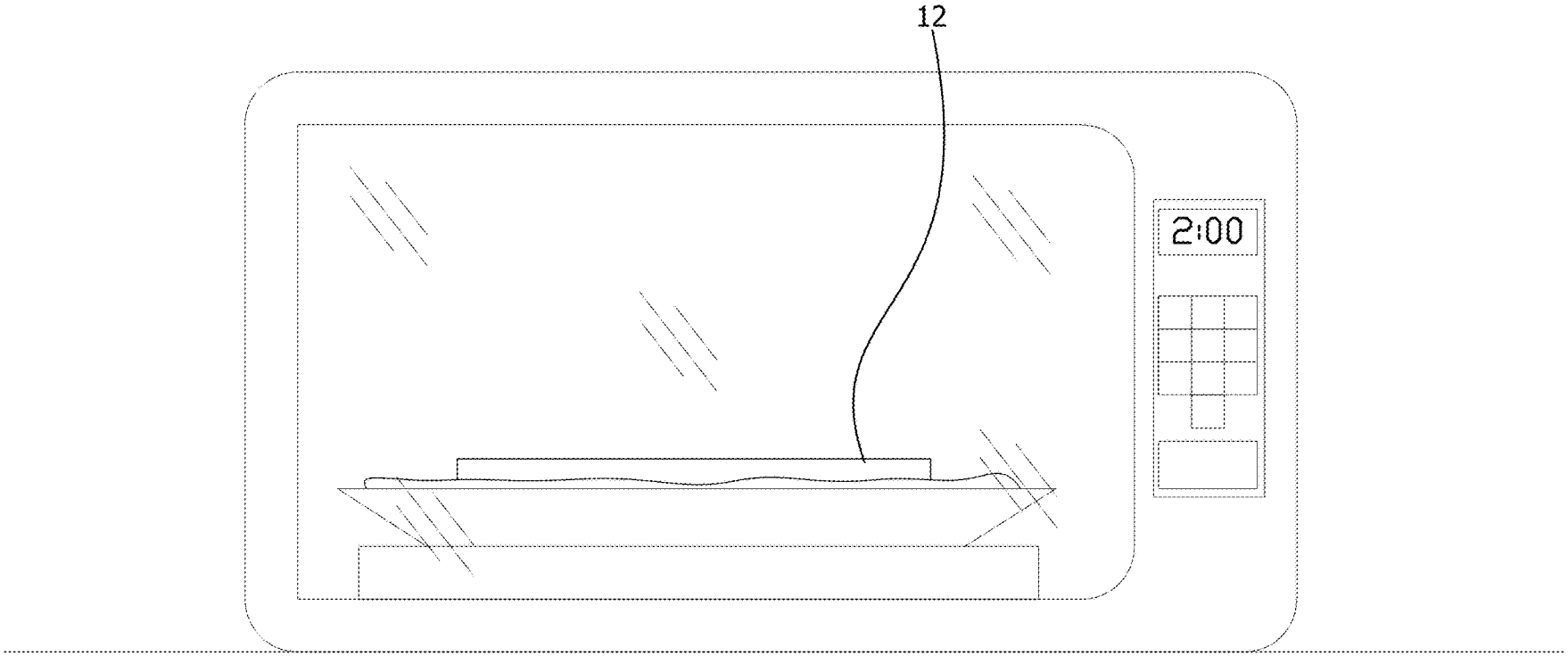
FIG. 4 is a perspective in-use view of an embodiment of the disclosure showing a pad being heated in a microwave oven.

As is shown in FIGS. 3 and 4, the pad 12 can be warmed in an oven, such as a microwave oven or a conventional oven for example, to a temperature that exceeds the melting temperature of the pad 12. Furthermore, the melting temperature of the pad 12 may be a temperature ranging between approximately 130.0 degrees Fahrenheit and 150.0 degrees Fahrenheit to enable the pad 12 to be poured with minimal risk of a third degree burn to the user 14. The duration of time that the pad 12 is heated in the microwave oven is no greater than twenty seconds to ensure the temperature of the pad 12 does not reach a temperature that could potentially cause a third degree burn on the user 14 if the pad 12 were to be accidentally spilled on the user 14 while the pad 12 is in the liquid phase. The pad 12 can be cooled below the melting temperature in a refrigerator, for example, or by extended exposure to ambient air. Additionally, the mold 16 may be a dinner plate or a bowl or other type of kitchen ware that would commonly be found in the user's 14 home.

A plurality of beads 18 is provided and each bead 18 of the plurality of beads 18 is insertable into the pad 12 when the pad 12 is in the first state. Furthermore, the plurality of beads 18 can be partially submerged into the pad 12 by the user 14 when the pad 12 is in the first state. Each bead 18 of the plurality of beads 18 is removable from the pad 12 when the pad 12 is in the second state to soothe a picking urge of the user 14. The picking urge may be a compulsive urge to pick at themselves or other type of habitual picking behavior the user 14 wishes to curtail. Additionally, each bead 18 of the plurality of beads 18 has a unique shape with respect to other beads 18 of the plurality of beads 18 to visually stimulate the user 14. Each bead 18 of the plurality of beads 18 is comprised of a thermally resistant material, including but not being limited to glass or plastic or ceramic, such that each bead 18 of the plurality of beads 18 has a melting point that is significantly higher than the melting temperature of the pad 12.

Each bead 18 of the plurality of beads 18 is insertable into the pad 12 when the pad 12 is thermally activated into the liquid phase. Additionally, each bead 18 of the plurality of beads 18 has a height that is greater than a height of the mold 16 such that each bead 18 of the plurality of beads 18 is partially submerged in the pad 12. The liquid phase of the pad 12 enables the user 14 to arrange the plurality of beads 18 in an arrangement chosen by the user 14. Each bead 18 of the plurality of beads 18 is removably integrated into the pad 12 when the pad 12 is thermally activated into the solid phase. Furthermore, each bead 18 of the plurality of beads 18 can be plucked from the pad 12 by the user 14 when the pad 12 is in the solid phase thereby soothing the picking urge of the user 14.

A tool 20 is provided and the tool 20 is urgeable into a gripping condition such that the user 14 can employ the tool 20 to remove each bead 18 of the plurality of beads 18 from the pad 12 when the pad 12 is in the second state. The tool 20 enables the user 14 to soothe their picking urge when the user 14 employs the tool 20 to remove each bead from the pad 12. The tool 20 is biased into a releasing condition to release each bead 18 of the plurality of beads 18 when the user 14 releases the tool 20. Furthermore, the tool 20 may comprise a pair of tweezers or a pair of pliers or other similar type of gripping tool.

The tool 20 includes a first member 22 and a second member 24. The first member 22 has a first end 26 which is coupled to a first end 28 of the second member 24 such that the first member 22 is oriented to extend along the second member 24. Furthermore, the first member 22 and the second member 24 is biased to angle away from each other such that a second end 30 of the first member 22 is spaced from a second end 32 of the second member 24. Each of the first member 22 and the second member 24 can be squeezed together by the user 14 for gripping a respective bead 18 of the plurality of beads 18.

Figure 2:
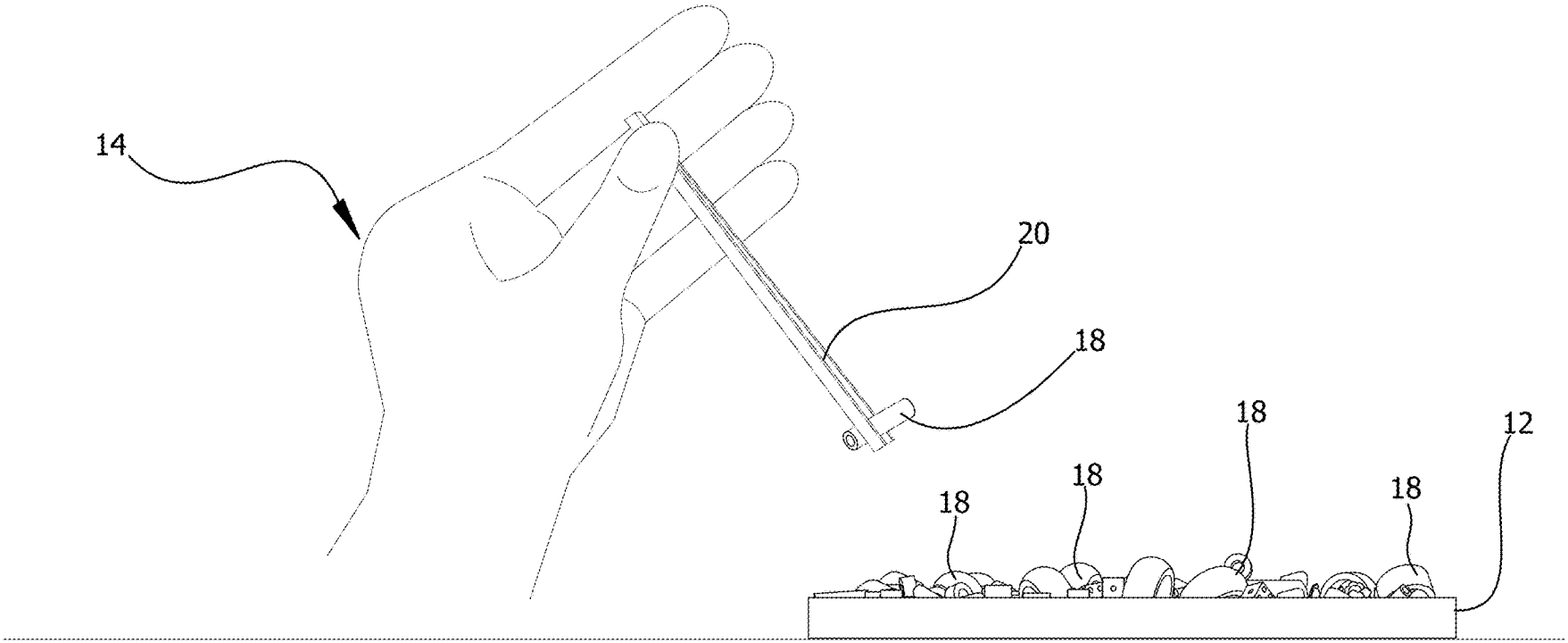
FIG. 2 is a perspective in-use view of an embodiment of the disclosure showing a user employing a tool to remove a plurality of beads from a pad.
Figure 5:
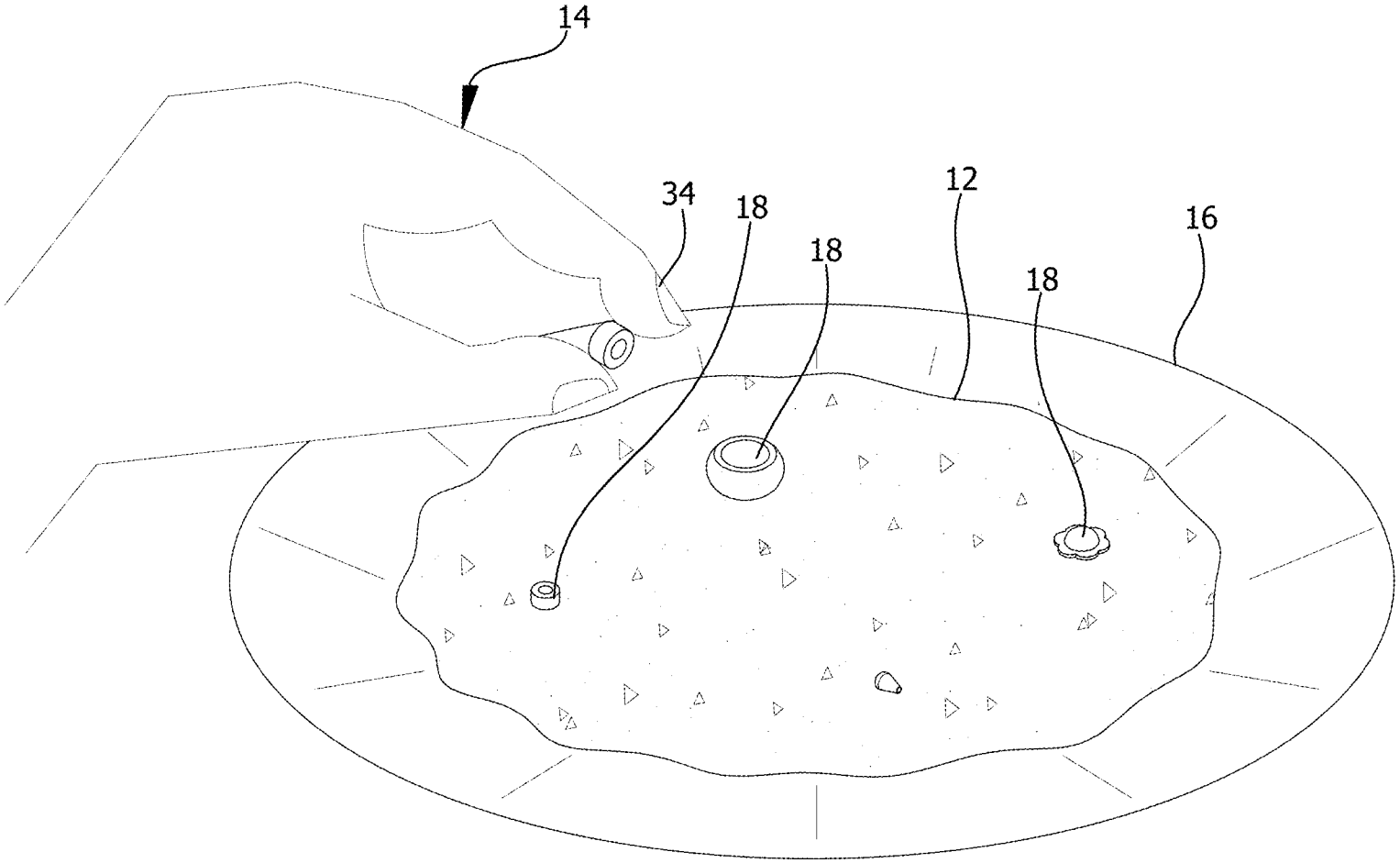
FIG. 5 is a perspective in-use view of an embodiment of the disclosure showing a user removing beads from a pad with their fingers.

In use, the pad 12 placed in an oven safe container and the pad 12 is heated to a temperature that exceeds the melting temperature of the pad 12 to enable the pad 12 to transition into the liquid phase. The pad 12 is poured into the mold 16 while the pad 12 is in the liquid phase and each bead 18 of the plurality of beads 18 is partially submerged in the pad 12 in an arrangement chosen by the user 14. The pad 12 is cooled to a temperature that is below the melting temperature of the pad 12 to enable the pad 12 to transition in the solid phase. As is shown in FIG. 2, the tool 20 is employed by the user 14 to remove each bead 18 of the plurality of beads 18 from the pad 12 when the pad 12 has transitioned into the solid phase thereby soothing the picking urge of the user 14. As is shown in FIG. 5, the user 14 can employ their fingers 34 to remove each bead 18 of the plurality of beads 18 from the pad 12 rather than employing the tool 20, depending upon the preference of the user 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A picking fidget device for soothing a picking urge of a user, said device comprising:

a pad being comprised of a thermoplastic material such that said pad transitions between a first state and a second state depending upon a temperature of said pad wherein said pad is configured to be warmed or cooled by a user;

a plurality of beads, each bead of said plurality of beads being insertable into said pad when said pad is in said first state wherein said plurality of beads is configured to be partially submerged into said pad by the user, each bead of said plurality of beads being removable from said pad when said pad is in said second state wherein said plurality of beads is configured to soothe a picking urge of the user, each bead of said plurality of beads having a unique shape with respect to other beads of said plurality of beads wherein said plurality of beads is configured to visually stimulate the user; and a tool being urgeable into a gripping condition wherein said tool is configured to be employed by the user to remove each bead of said plurality of beads from said pad when said pad is in said second state for soothing the picking urge of the user when the user squeezes said tool, said tool being biased into a releasing condition wherein said tool is configured to release each bead of said plurality of beads when the user releases said tool.

2. The picking fidget device according to claim 1, wherein said pad is thermally activated into a liquid phase when said pad is heated above a melting temperature of said pad.

3. The device according to claim 2, wherein said pad is pourable into a mold when said pad is in said liquid phase.

4. The picking fidget device according to claim 3, wherein:

said pad is thermally activated into a solid phase when said pad is cooled below a melting temperature of said pad; and said pad solidifies in said mold when said pad is in said solid phase.

5. The picking fidget device according to claim 3, wherein:

each bead of said plurality of beads is insertable into said pad when said pad is thermally activated into said liquid phase; and each bead of said plurality of beads has a height being greater than a height of said mold such that each bead of said plurality of beads is partially submerged in said pad wherein said plurality of beads is configured to be arranged by the user in said pad.

6. The picking fidget device according to claim 4, wherein each bead of said plurality of beads is removably integrated into said pad when said pad is thermally activated into said solid phase wherein each bead of said plurality of beads is configured to be plucked from said pad by the user.

7. The picking fidget device according to claim 1, wherein:

said tool includes a first member and a second member; and said first member has a first end being coupled to a first end of said second member such that said first member is oriented to extend along said second member.

8. The picking fidget device according to claim 6, wherein said first member and said second member are biased to angle away from each other such that a second end of said first member is spaced from a second end of said second member wherein each of said first member and said second member is configured to be squeezed together by the user for gripping a respective bead of said plurality of beads.

9. A picking fidget device for soothing a picking urge of a user, said device comprising:

a mold;

a pad being comprised of a thermoplastic material such that said pad transitions between a first state and a second state depending upon a temperature of said pad wherein said pad is configured to be warmed or cooled by a user, said pad being thermally activated into a liquid phase when said pad is heated above a melting temperature of said pad, said pad being pourable into said mold when said pad is in said liquid phase, said pad being thermally activated into a solid phase when said pad is cooled below said melting temperature of said pad, said pad solidifying in said mold when said pad is in said solid phase;

a plurality of beads, each bead of said plurality of beads being insertable into said pad when said pad is in said first state wherein said plurality of beads is configured to be partially submerged into said pad by the user, each bead of said plurality of beads being removable from said pad when said pad is in said second state wherein said plurality of beads is configured to soothe a picking urge of the user, each bead of said plurality of beads having a unique shape with respect to other beads of said plurality of beads wherein said plurality of beads is configured to visually stimulate the user, each bead of said plurality of beads being insertable into said pad when said pad is thermally activated into said liquid phase, each bead of said plurality of beads having a height being greater than a heigh of said mold such that each bead of said plurality of beads is partially submerged in said pad wherein said plurality of beads is configured to be arranged by the user in said pad, each bead of said plurality of beads being removably integrated into said pad when said pad is thermally activated into said solid phase wherein each bead of said plurality of beads is configured to be plucked from said pad by the user; and a tool being urgeable into a gripping condition wherein said tool is configured to be employed by the user to remove each bead of said plurality of beads from said pad when said pad is in said second state for soothing the picking urge of the user when the user squeezes said tool, said tool being biased into a releasing condition wherein said tool is configured to release each bead of said plurality of beads when the user releases said tool, said tool including a first member and a second member, said first member having a first end being coupled to a first end of said second member such that said first member is oriented to extend along said second member, said first member and said second member being biased to angle away from each other such that a second end of said first member is spaced from a second end of said second member wherein each of said first member and said second member is configured to be squeezed together by the user for gripping a respective bead of said plurality of beads.

10. A method of soothing a picking urge of a user, the steps of the method comprising:

heating a pad being comprised of a thermoplastic above a melting temperature of said pad thereby converting said pad into a liquid state;

pouring said pad into a mold when said pad is converted into said liquid state;

positioning each bead of a plurality of beads into said pad when said pad is in said liquid state such that each bead of said plurality of beads is partially submerged in said pad;

cooling said pad below said melting temperature of said pad thereby converting said pad into a solid state; and removing each bead of said plurality of beads from said pad when said pad is in said solid state wherein said plurality of beads is configured to soothe the picking urge of the user.

* * * * *